US008120889B2

(12) United States Patent
Fan et al.

(10) Patent No.: US 8,120,889 B2
(45) Date of Patent: Feb. 21, 2012

(54) TAILORED EMITTER BIAS AS A MEANS TO OPTIMIZE THE INDIRECT-CHARGING PERFORMANCE OF A NANO-STRUCTURED EMITTING ELECTRODE

(75) Inventors: Fa-Gung Fan, Fairport, NY (US); Joseph A. Swift, Ontario, NY (US); Michael F. Zona, Holley, NY (US); David H. Pan, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 671 days.

(21) Appl. No.: 12/132,913

(22) Filed: Jun. 4, 2008

(65) Prior Publication Data

US 2009/0303654 A1 Dec. 10, 2009

(51) Int. Cl.
*G03G 15/02* (2006.01)
*H01H 47/32* (2006.01)
*H05F 3/00* (2006.01)

(52) U.S. Cl. ..... 361/229; 361/230; 399/168; 399/170; 399/171; 399/172; 399/173

(58) Field of Classification Search ..... 361/229–230; 399/168, 170–173
See application file for complete search history.

(56) References Cited

U.S. PATENT DOCUMENTS 5,300,986 A * 4/1994 Mishra et al. ..... 399/171
5,873,523 A * 2/1999 Gomez et al. ..... 239/3
6,308,033 B1 * 10/2001 Kato ..... 430/118.5
6,493,529 B1 * 12/2002 Umemura et al. ..... 399/168
7,149,460 B2 * 12/2006 Hays ..... 399/252
7,398,035 B2 * 7/2008 Zona et al. ..... 399/168
7,466,942 B2 * 12/2008 Zona et al. ..... 399/168
7,805,095 B2 * 9/2010 Zona et al. ..... 399/168
7,907,869 B2 * 3/2011 Takenaka et al. ..... 399/115
7,970,318 B2 * 6/2011 Iwamatsu et al. ..... 399/168
7,995,952 B2 * 8/2011 Pan et al. ..... 399/168
2006/0280524 A1 * 12/2006 Hays et al. ..... 399/168
2008/0199195 A1 * 8/2008 Swift et al. ..... 399/50
2009/0116872 A1 * 5/2009 Sugimoto et al. ..... 399/168
2011/0058852 A1 * 3/2011 Jeong et al. ..... 399/171
2011/0134580 A1 * 6/2011 Suzuki et al. ..... 361/212

* cited by examiner

*Primary Examiner* — David Gray
*Assistant Examiner* — Geoffrey Evans
(74) *Attorney, Agent, or Firm* — MH2 Technology Law Group LLP

(57) ABSTRACT

Exemplary embodiments provide charging systems and methods for effectively delivering charges onto a receptor. The charging system can include a low velocity gas stream, an emitter assembly for providing cathode-to-anode field bias to generate charges from the low velocity gas stream, and an emitter-to-receptor (e.g., photoreceptor) electric bias to enhance the charge delivery to the receptor. The disclosed charging systems and methods can be used to achieve an optimal charging performance at a low projected cost for any suitable receptor that needs to be charged. Exemplary receptors can include a photoreceptor (PR) such as a belt PR or a drum PR, a toner layer, a sheet of media on which toner can be deposited, or a transfer belt in an electrophotographic printing machine.

21 Claims, 2 Drawing Sheets

TAILORED EMITTER BIAS AS A MEANS TO OPTIMIZE THE INDIRECT-CHARGING PERFORMANCE OF A NANO-STRUCTURED EMITTING ELECTRODE

FIELD OF THE INVENTION

This invention relates generally to electron emitters and related charging devices and, more particularly, to charging devices having a means to optimize the indirect charging performance of a nano-structured emitting electrode.

BACKGROUND OF THE INVENTION

In the electrophotographic process, various charging devices are needed to charge a photoreceptor (PR), recharge a toner layer, charge an intermediate transfer belt for electrostatic transfer of toner, or charge/discharge a sheet of media, such as a sheet of paper. Recent attempts for the charging devices have employed nanostructures (e.g., nanowires, nanotubes, nanorods, nanofibers and nanodots) as the electron emitting electrode contained in the subject charging device. For example, the charging devices may be a direct charging device including an emitter array of carbon nanotubes (CNTs) juxtapositioned and facing but spaced slightly away from the photoreceptor (PR). An electric bias is then applied between the CNT array and the PR to establish an electric field with the objective to initiate and sustain electron emission at the nanotube tips and to thereby generate and direct charges to the PR surface.

In another example, the charging devices may include one or more electrodes containing nano-structured arrays of electron emitting elements which may be employed as an indirect charging device that also employs a gas channel to create a high-speed gas stream impinging upon the photoreceptor. In this case, nano-structured arrays are configured inside the gas channel to generate charges that are captured on or within the gas molecules moving in the channel. The gas ions are then delivered to the PR surface by this high-speed impinging jet. Such indirect charging devices and their methods reduce the extrinsic contamination to the nano-structure array(s) and also provide a reduced device size which may result in an extreme reduction on the amount of waterfront on the receptor requiring direct access by the charger. Thus a smaller size printer, copier, fax, and/or multifunctional product may result.

Problems arise, however, because the delivery of charges to the photoreceptor relies on the gas stream in the gas channel, which generally requires high gas velocity (e.g., close to the speed of sound in air) as well as a high-density ion source (i.e., high space charge density) in order to deliver sufficient ions and charge to the photoreceptor. These requirements have proven to be a challenge to the widespread implementation of the indirect charging devices of the prior art.

Thus, there is a need to overcome these and other problems of the prior art and to provide an improved indirect charging system and method that can provide high charging performance operating with low velocity gas streams and low ion densities.

SUMMARY OF THE INVENTION

According to various embodiments, the present teachings include a charging device. The charging device can include a first electrode and a second electrode separated from the first electrode, and at least one of the first electrode and the second electrode can include a plurality of nanostructures. The charging device can also include a first voltage supply connected between the first electrode and the second electrode to impart charge to a portion of a gaseous material that can then be deposited on a receptor. The charging device can further include a second voltage supply connected between the receptor and one of the first electrode and the second electrode.

According to various embodiments, the present teachings also include a charging device. The charging device can include a first electrode and a second electrode that is separated from the first electrode by a gap, and at least one of the first electrode and the second electrode can include a plurality of nanostructures. The charging device can also include a receptor positioned adjacent to the gap separating the first electrode from the second electrode. An aperture electrode (or grid electrode) can be placed in close proximity to the gap separating the first electrode and the second electrode and positioned in a space between the receptor and the first electrode and the second electrode. The charging device can further include a first voltage supply connected between the first electrode and the second electrode; a second voltage supply connected between the aperture electrode and the receptor; and a third voltage supply connected between one of the first electrode and the second electrode and the receptor.

According to various embodiments, the present teachings further include a method of charging a receptor in a charging device. In this method, a first voltage can be applied between a first electrode and a second electrode, and at least one of the first electrode and the second electrode is coated with a plurality of nanostructures. A gaseous material can then be supplied at a speed between the first and second electrode such that an electric field on the nanostructures charges a portion of the gaseous material. The charged gaseous material can be directed towards a receptor using a second voltage bias between the receptor and an aperture electrode; and a third electric bias between the receptor and one of the first electrode and the second electrode.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE EMBODIMENTS

Figure 1:
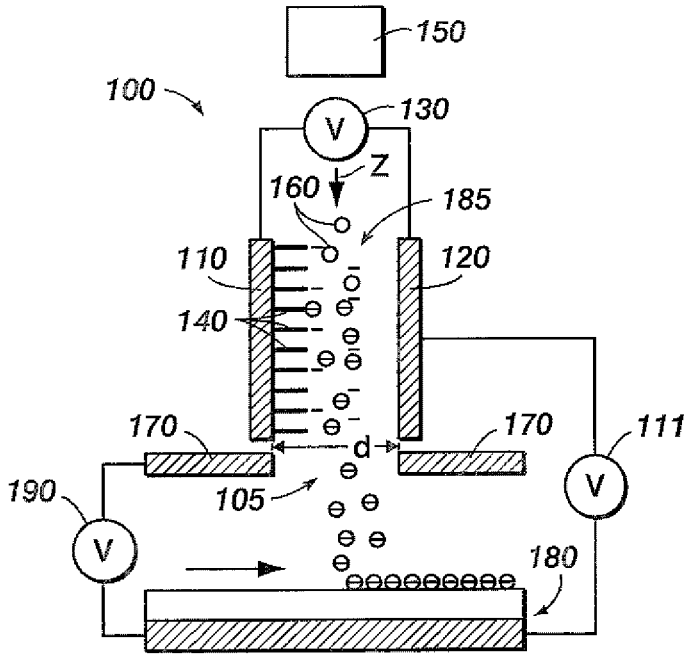
FIG. 1 depicts an exemplary charging device in accordance with the present teachings.

Reference will now be made in detail to the present embodiments (exemplary embodiments) of the invention, an example of which is illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the invention may be practiced. These embodiments are described in sufficient detail to enable those skilled in the art to practice the invention and it is to be understood that other embodiments may be utilized and that changes may be made without departing from the scope of the invention. The following description is, therefore, merely exemplary.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B. The term "at least one of" is used to mean one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g., −1, −2, −3, −10, −20, −30, etc.

Exemplary embodiments provide charging systems and methods for effectively delivering charges onto a receptor (e.g., photoreceptor). The charging system can include a low velocity gas stream, an emitter assembly for providing a cathode-to-anode field bias to generate charges from and within the low velocity gas stream, and an emitter-to-receptor electric bias to enhance the charge delivery to the receptor. Specifically, an appropriate electric field can be established between the emitter's cathode and the counter electrode (anode) to charge (or to ionize) gas molecules and/or atoms that are captured and transported by the low velocity gas stream, which may be an air stream. In addition, a bias voltage can be established between the emitter assembly and the receptor in order to provide a second electric field to assist in transport and directional focus of the charged gas stream. The disclosed charging systems and methods can be used to achieve an effective, and expectedly optimal, charging performance at a low projected cost for any suitable receptor that needs to be charged. Exemplary receptors can include a photoreceptor (PR) such as a belt PR (with, for example a backer bar to control the position of the PR with respect to the charger) or a drum PR, a toner layer, a sheet of media on which toner can be deposited, or a transfer belt in an electrophotographic printing machine, or other similar surfaces.

In various embodiments, the emitter assembly that is used to generate the cathode-to-anode field can employ, for example, a direct current (DC) bias, a pulsed DC, an alternating current (AC), or an biased AC emitter signal. The charge species can be generated by, for example, electric field electron emission of the nanostructures, or ionization, micro-corona, and/or corona occurring in the emitter region. Alternatively, the charge species can be generated from processes that involve electron attachment and/or dissociative attachment.

As used herein, the term "electron emission" refers to the movement of electrons from the solid state material of the nanostructured electrode into the surrounding gaseous space under conditions of an electric field. The related term "electron emitter" refers to the nanostructured electrodes including, but not limited to, its constituent material(s) and design. Owing to the fact that a practical commercial charging device functions in the open environment, electron emission can lead to and simultaneously occur with corona, or micro-corona phenomena. Thus, the term "electron emission" herein is used in the broader sense and includes onset of field driven electron emission as well as sustentation of emission current and micro-corona/corona phenomena.

In embodiments where nanostructures are involved in the emitter assembly of the charging system, various forms and the materials can be used for the nanostructures including, but not limited to, carbon nanotubes (CNTs), Boron Nitride (BN) nanotubes, metal nanorods, nanowires, nanodots, nanofibers, nanowhiskers, and nanohorns. For example, nanostructures (e.g., nanowires or nanowire composites) can be fabricated suited for field emission applications. In an exemplary embodiment, metal oxide-based nanostructures, such as ZnO-based nanostructures (e.g., 1-D nanostructural ZnO or ZnO nanowires), can be used for efficient field emitters. For example, the ZnO nanowires can be particularly suited to produce field emission with low threshold and high efficiency, because the oxide material is thermally stable and intrinsically oxidation resistant. In various embodiments, doped metal-oxide-based nanostructures can be used for the field emitters. For example, ZnO nanowires can be doped to further improve the electron emission performance. Various dopants, such as n-type dopants chosen from a group consisting of: Ga, Si, Ge, Sn, S, Se and Te, can be used. This n-type doping can enhance field emission by lifting the Fermi level and lowering the work function.

In embodiments where ionization/micro-coronas/coronas are involved in the emitter charging process, both positive and negative charge species can be generated, wherein desired "right"-sign charges can be extracted and undesired "wrong"-sign charges can be rejected by the electric bias of the emitter assembly with respect to the receptor.

The gas stream, e.g., a low velocity gas stream, can include one or more gases chosen from oxygen, ozone, nitrogen, argon, carbon dioxide, or water vapor. In various embodiments, different gases can be applied to different gas channels in order to further enhance the performance of the charging system or for other purposes. In some embodiments where the gas molecules are not strongly electronegative or their electron attachment cross sections are small, the charge species in the emitter can be essentially electrons. In this case, gas flows can become ineffective in extracting the charges (electrons) from the emitter. The electric field can thus be the only mechanism to extract and deliver electrons to the receptor.

Figure 2:
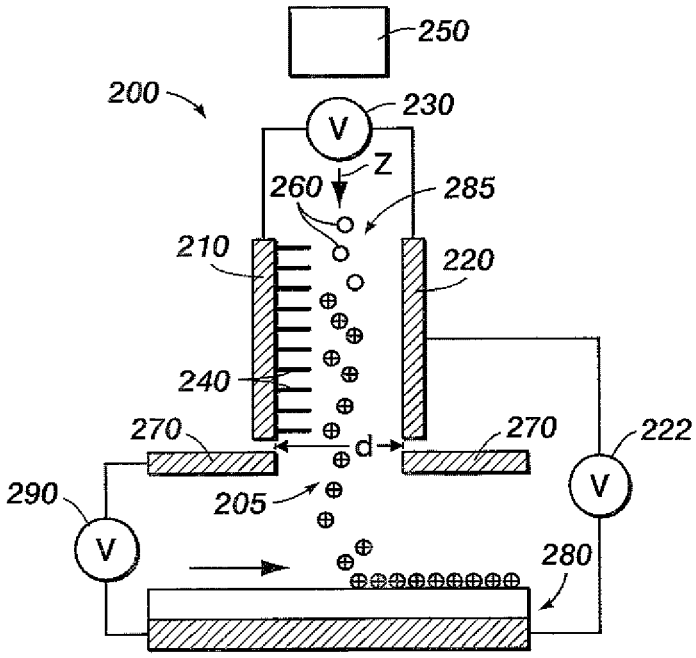
FIG. 2 depicts another exemplary charging device in accordance with the present teachings.
Figure 3:
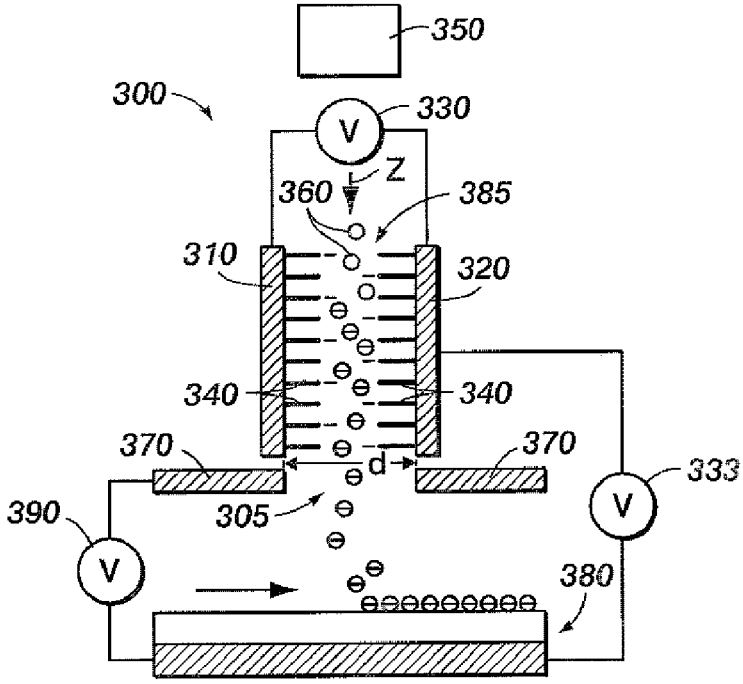
FIG. 3 depicts an additional exemplary charging device in accordance with the present teachings.

FIGS. 1-3 depict various exemplary charging devices that can be used to charge a receptor in, for example, an electrophotographic process, while using low gas velocity, and producing an enhanced charging voltage to the receptor in accordance with the present teachings. In various embodiments, the disclosed charging devices can be an improved charging device by tailoring an emitter-to-receptor bias as a means to optimize the indirect charging performance of a nanotechnology-based charger. The nanotechnology-based emission chargers can be the charging devices as disclosed in the related U.S. patent application Ser. No. 11/149,392, and entitled "Compact Charging Method and Device with Gas Ions Produced by Electric Field Electron Emission and Ionization from Nanotubes", the disclosure of which is incorporated herein by reference in its entirety.

For example, the charging device can include an emitter-biased compact negative charging device in which negative ion gas molecules and/or atoms can be generated by exposing the gaseous material to an electric field electron emission using nanostructures (e.g., nanotubes). In another example, the charging devices described herein can include an emitter-biased compact positive charging device in which a gaseous material including gas molecules and/or atoms can be ionized by an electric field using nanostructures (e.g., nanotubes).

FIG. 1 shows an exemplary charging device 100 in accordance with the present teachings. As shown in FIG. 1, the charging device 100 can include a first electrode 110, a second electrode 120, a first voltage supply 130 electrically connected to the first electrode 110 and the second electrode 120, a plurality of nanostructures such as nanotubes 140 physically adhering to the first electrode 110, a gas supply unit 150 that can supply a gaseous material 160 into a charging zone 185, also called a gap, between the first electrode 110 and the second electrode 120, and a grid 170 (or aperture electrode). The charging device 100 can be used to supply charge to a receptor, such as the multilayered receptor 180 including a top layer and a bottom layer. The bottom layer of the receptor can be a substrate that can be used as a back electrode or as a ground plane. In addition, a second voltage supply 190 can be electrically connected between the grid 170 and the substrate of the receptor 180, and a third voltage supply 111 can be electrically connected between one of the first and second electrodes 110/120 of the emitter assembly and the substrate of the receptor 180.

While FIG. 1 depicts the plurality of nanostructures adhering to the first electrode 110, it will be understood that in various embodiments, the plurality of nanostructures can be formed on the first electrode 110 and/or the second electrode 120. Moreover, it should be understood that there can be multiple, closely spaced charging zones 185 arranged in the process direction (i.e., the direction the receptor moves) to allow high process speed charging of the receptor 180. It is also understood that the distance between the electrodes 110, 120 can be uniform across the entire surface areas of the electrodes, or alternately can be variable and form, for example, a tapered or funnel-shaped gap residing between the subject electrodes.

The substrates of the first electrode 110 and the second electrode 120 of the emitter assembly can be made from various conductive materials such as metals, indium tin oxide coated glass, doped silicon, and conductive organic composite materials. The dimensions of the electrodes are typically millimeters or centimeters in the direction of the gas flow and tens of centimeters in the cross process direction. Further, the first electrode and the second electrode can be closely spaced, separated by a distance (d). The distance (d) can be, for example, from about 1 μm to about 500 μm, in some cases, from about 10 μm to about 300 μm. The electrodes can be arranged substantially parallel to, and opposing, one another to form the charging zone 185 between the first electrode 110 and the second electrode 120.

The nanostructures, such as the exemplary nanotubes 140, can include various materials including, but not limited to, carbon, boron nitride, and zinc oxide, bismuth, metals, metal oxides, doped metal oxides, and metal chalcogenides. In addition, the nanostructures can be overcoated or surface modified to achieve operational stability in various gas environments. As used herein, the term nanostructures/nanotubes can refer to, for example, single-walled nanotubes (SWNT), multi-walled nanotubes (MWNT), horns, spirals, wires, and/or fibers. Typically, nanotubes 140 can be 1 to 500 nanometers in diameter and can be up to hundreds of microns in length. By controlling various parameters, such as composition, shape, length, etc., the electrical, mechanical, and thermal properties of the nanotubes can be controlled. For example, the nanotubes can be formed to be conducting, semiconducting, or insulating, depending on, for example, the chirality of the nanotubes. Moreover, the nanotubes can have yield stresses greater than that of steel. Additionally, the nanotubes can have thermal conductivities greater than that of copper, and in some cases, comparable to, or greater than that of diamond.

The nanotubes 140 can be fabricated by a number of methods including arc discharge, pulsed laser vaporization, chemical vapor deposition (CVD), high pressure carbon monoxide processing, or any other suitable techniques. According to various embodiments, the nanotubes 140 can be formed to have their principle axis perpendicular to the substrate on which they are adhered, such as the first electrode 110 and/or the second electrode 120. In the case of fabrication using CVD with a catalyst, the nanotubes can be SWNT and can orient perpendicular to the substrate as shown, for example, in FIGS. 1-3.

The nanotubes 140 can be irregularly and in certain embodiments, regularly spaced (e.g., spaced apart from each other at a distance that is typically greater than an average height of the nanotubes) on at least a portion of one of the first electrode 110 and/or second electrode 120. In some embodiments, the nanotubes can form a regular lattice such as a hexagonal array.

According to various embodiments, the first voltage supply 130 can apply a negative DC bias to the electrode including the nanotubes, such as the first electrode 110 shown in FIG. 1. The negative DC bias can cause an electron field emission from the nanotubes 140. The electron field emission supplies electrons, shown as a negative sign (−) in FIG. 1, to the charging zone 185. According to various embodiments, the first DC voltage supply 130 can provide a voltage of from about 0.1 V/μm to about 5.0 V/μm between the first electrode 110 and the second electrode 120. Further, according to various embodiments, maximum electron field emission can be obtained when the nanotubes are regularly spaced and oriented generally perpendicularly to the conductive substrate.

For example, as shown in FIG. 1, gaseous material 160 can enter charging device 100 from gas supply unit 150. The negative bias applied to the first electrode 110 can supply electrons to the charging zone 185. Further, the electrons can cause a portion of the gaseous material 160 to become negatively charged, as represented by gaseous material 160 in the charging zone 185 being labeled with a negative (−) sign.

As shown in FIG. 1, the ionized gaseous material 160 flowing through charging zone 185 passes through grid 170. The second voltage supply 190, such as a DC voltage supply, can be electrically connected between the grid 170 and the receptor 180. According to various embodiments, the second DC voltage supply 190 can apply a negative bias to the grid 170 (or aperture electrode). The negative DC biased grid 170 can establish an electric filed between the charging device and the receptor 180. According to various embodiments, the second voltage supply 190 can provide a voltage of from about −400 volts to about −900 volts between the grid 170 and the receptor 180. When the surface potential of the receptor 180 becomes comparable to the negative DC bias applied by the second DC voltage supply 190, the charging on the receptor 180 ceases and the surface potential of the receptor can be approximately equal to the voltage supply 190. According to various embodiments, the receptor 180 can acquire a uniform surface potential even though the ion current may not necessarily be uniform in the cross process direction.

The charging device 100 can further include the third voltage supply 111 applied between the emitter assembly (e.g., the second electrode 120) and the receptor 180, which is also referred to herein as emitter-to-receptor (or emitter-to-PR) bias. The third voltage supply 111 can apply a negative DC bias to the emitter assembly and can establish an electric field to assist the charged gaseous material(s) deposited with a directional focus onto the receptor 180. According to various embodiments, the third DC voltage supply 111 can provide a negative bias of from about −400 volts to about −900 volts to the emitter assembly.

In an exemplary embodiment, the emitter assembly can be set to about 700 V bias with the voltage drop across the emitter assembly at about 600 V. For example, when the emitter-to-receptor bias is used for the disclosed negative charging device 100, the anode (e.g., the second electrode 120 of FIG. 1) of the emitter assembly can be set at about −700V, and the cathode (e.g., the first electrode 110) can be set at about −1300V. As compared, for a conventional negative charging device with no emitter-to-receptor bias involved, the anode of the emitter assembly can be grounded and the cathode can be set at about −600 V in order to keep the voltage drop across the emitter assembly at about 600 V.

According to various embodiments, the gaseous material 160 flowing through the charging device 100 can contain electronegative molecular species to facilitate electron attachment on the gas molecules. For example, when air is used as the gaseous material 160, the dominant negative ion species at atmospheric pressure is $CO_3^-$. The precursor of $CO_3^-$ is $CO_2$ that reacts with $O^-$ or $O_3^-$ to form the $CO_3^-$ ion. Other examples of electronegative gaseous materials that can be used include, for example, $CO_2$ and $O_2$.

According to various embodiments, the gas supply unit 150 can be provided by one or more of a compressor, blower or pressurized gas cylinders. For example, the gas supply unit 150 can supply the gaseous material 160 at the required velocity and flow through the charging zone 185 generally in a direction Z. Because of the use of the emitter-to-receptor bias for the charging device 100, a lower gas velocity, as compared with the gas speed used in the prior art for the charging device, can be used. For example, the gas supply unit 150 can flow the gaseous material 160 in an air or gas stream at a low speed below 150 m/s. Alternatively, the range of gas speeds can be from about 50 m/s to about 135 m/s. According to various embodiments, the drift speed of the ionized gaseous material 160 from the first electrode to the second electrode under the influence of the field bias can be between 50 m/s and 1350 m/s depending on the bias, and in some cases, near 1000 m/s or higher.

Instead of a DC voltage between the first electrode 110 and the second electrode 120, a pulsed voltage source (e.g., the voltage supply 130 in FIG. 1) can be used. Use of pulsed DC waveform can minimize any space charge effect between electrodes 110 and 120. In various embodiments, a biased AC voltage source can be used. Use of this waveform can minimize any field driven drift of the ions between electrodes 110 and 120. Moreover, in certain embodiments to achieve electron field emission, the macroscopic electric field in the gap between the first electrode 110 and the second electrode 120 can be in the range of about 0.1 V/μm to about 5 V/μm.

FIG. 2 shows another exemplary charging device 200 in accordance with the present teachings. As shown in FIG. 2, the charging device 200 can include a first electrode 210, a second electrode 220, a first voltage supply 230 electrically connected to the first electrode 210 and the second electrode 220 of an emitter assembly, a plurality of nanostructures such as nanotubes 240 physically contacting or being adhered to the first electrode 210, a gas supply unit 250 that can supply a gaseous material 260 into a charging zone 285, also called a gap, between the first electrode 210 and the second electrode 220, and a grid 270 (or aperture electrode). The charging device 200 can be used to supply charge to the receptor 280. The charging device 200 can also include a second voltage supply 290 electrically connected between the grid 270 and the substrate of the receptor 280. Furthermore, the charging device 200 can include a third voltage supply 222 electrically connected between one of the emitter assembly electrodes (e.g., the second electrode 220) and the substrate of the receptor 280.

While FIG. 2 shows the plurality of nanostructures adhering to the first electrode 210, it will be understood that in various embodiments, the plurality of nanostructures can be formed on the first electrode 210 and/or the second electrode 220. Moreover, it should be understood that there can be multiple, closely spaced charging zones 285 arranged in the process direction to allow high process speed charging of the receptor 280.

According to various embodiments, the first electrode 210, the second electrode 220, the nanostructures 240 including their arrangement, the gas supply unit 250, the grid 270, and the receptor 280 can be similar to those described above in FIG. 1.

The first voltage supply 230 can apply, e.g., a positive DC bias to the electrode including the nanostructures, such as the first electrode 210 shown in FIG. 2. By applying positive bias to the first electrode, the high electric field near the tips of the nanostructures 240 can cause ionization (e.g., electron removal) of gas molecules or atoms in the gaseous material 260 flowing through charging zone 285. Further, according to various embodiments, maximum field ionization can be obtained when the nanostructures are regularly spaced and oriented generally perpendicularly to the conductive substrate.

For example, as shown in FIG. 2, gaseous material 260 can enter charging device 200 from gas supply unit 250. The positive bias applied to the first electrode 210 can cause a portion of the gaseous material 260 to become positively charged, as represented by gaseous material in the charging zone 285 being labeled with a plus (+) sign.

As shown in FIG. 2, the ionized gaseous material 260 flowing through the charging zone 285 passes through grid 270. A second voltage supply 290, such as a DC voltage supply, can be electrically connected between the grid 270 and the substrate of the receptor 280. According to various embodiments, the second DC voltage supply 290 can apply a positive DC bias to the grid 270 and can establish an electric field between the ion charging device and the receptor 280. According to various embodiments, the second DC voltage supply 290 can provide a voltage of about +400 volts to about +900 volts between the grid 270 and the receptor 280. When the surface potential of the receptor 280 becomes comparable to the positive DC bias applied by the second DC voltage supply 290, the charging of the receptor 280 ceases and the surface potential of the receptor is approximately equal to the voltage supply 290. According to various embodiments, the receptor 280 can acquire a relatively uniform surface potential even in cases where the ion current is not necessarily uniform in the cross process direction.

The charging device 200 can further include the third voltage supply 222 applied between the emitter assembly (e.g., the second electrode 220) and the receptor 280, which is also referred to herein as the emitter-to-receptor (or emitter-to-PR) bias. The third voltage supply 222 can apply, e.g., a positive DC bias to the emitter assembly and can establish an electric field to assist the charged gaseous material(s) (i.e., positive ions) deposited with a directional focus onto the receptor 280. According to various embodiments, the third DC voltage supply 222 can provide a positive bias of from about +400 volts to about +900 volts to the emitter assembly.

According to the exemplary embodiment for positive charging (as shown in FIG. 2), the gaseous material 260 can include an inert gas, such as helium, and $N_2$, or $O_2$, and $H_2O$. The gaseous material 260 can be ionized when exposed to an intensified electric field at the ends (tips) of the nanostructures. For example, helium, which has a relatively high ionization potential of about 24.6 eV, can be ionized. For gasses with lower ionization potentials, the field ionization threshold can be reduced. Other exemplary ionization potentials include 14.5 eV for $N_2$, 13.6 for $O_2$, and 12.6 for $H_2O$.

According to various embodiments, the gas supply unit 250 can be provided by any of the following which include a compressor, blower or pressurized gas cylinder. For example, the gas supply unit 250 can supply the gaseous material 260 at desired velocity and flow rate through the charging zone 285 generally in a direction Z. In some embodiments, the gas supply unit 250 can flow the gaseous material 260 in an air or gas stream at a lower speed as compared with the gas speed used in the prior art, which is typically near the speed of sound, i.e., about 340 m/s. For example, the gas speeds as disclosed herein can be below 150 m/s. According to various embodiments, the drift speed of the ionized gaseous material 160 from the first electrode to the second electrode can be between 50 m/s and 1350 m/s, and in some cases, near 1000 m/s.

Instead of a DC voltage between the first electrode 210 and the second electrode 220, a pulsed voltage source (e.g., for 230 in FIG. 2) can be used. Use of pulsed DC waveform can minimize any space charge effect between electrodes 210 and 220. In various embodiments, a biased AC voltage source can be used.

According to various embodiments, the second voltage supply 290 applied between the charging device and the receptor 280 can provide an ion deposition electric field that collapses when the surface potential on the receptor 280 becomes comparable to that of charging device bias from the second voltage supply 290. According to various embodiments, the third voltage supply 222 applied between the emitter assembly and the receptor 280 can provide an improved charging performance, and a low velocity for the gaseous material 260 flowing through charging zone 285. According to various embodiments, the charging device 200 can enable a small size (e.g. the length in the process direction) without producing undesired molecular species, such as oxidizing agents of ozone and nitric oxides, for example.

FIG. 3 shows an additional exemplary charging device 300 in accordance with the present teachings. As shown in FIG. 3, the charging device 300 can include a first electrode 310, a second electrode 320, a (biased) AC voltage supply 330 electrically connected to the first electrode 310 and the second electrode 320, a plurality of nanostructures that can be in the form of nanotubes 340 physically adhering to the first electrode 310 and the second electrode 320, a gas supply unit 350 that can supply a gaseous material 360, into a charging zone 385, also called a gap, between the first electrode 310 and the second electrode 320, and a grid 370 (or aperture electrode). The charging device 300 can supply charge to a receptor 380. A third voltage supply 333 can be applied between the emitter assembly (e.g., the second electrode 320) and the receptor 380 to provide an emitter-to-receptor bias. It should be understood that there can be multiple, closely spaced charging zones 385 arranged in the process direction to allow high speed charging of the receptor 380.

According to various embodiments, the first electrode 310, the second electrode 320, the nanotubes 340 including their arrangement, the gas supply unit 350, the grid 370, and the receptor 380 can be similar to those described above in FIGS. 1-2.

In FIG. 3, both the first electrode 310 and the second electrode 320 can be coated with nanostructures such as nanotubes 340. A square wave (biased) AC voltage from AC voltage supply 330 can be applied between the first electrode 310 and the second electrode 320. Alternatively, a series of voltage pulses can be used instead of the steady DC voltage during each half cycle. During the half AC cycle, electrons are field emitted into the charging zone 385 from the lower-potential electrode. During the next half cycle, the role of the coated electrodes is reversed. In this way, the gaseous material 360 flowing through the charging zone 385 can be alternately subjected to electrons from each of the nanotube covered electrodes.

According to various embodiments, when an electrode is at a positive potential, it is possible for gas molecules in the gaseous material 360 near the nanostructures to be field ionized. However, the threshold field for field ionization is typically larger than the threshold field for the electron emission. According to various embodiments, the third voltage supply 333 can apply a negative DC bias for extracting the negative ion from the charging zone 385 to the receptor 380.

According to various embodiments, if the biased-AC frequency 330 is sufficiently high to prevent ion deposition on the electrodes, the ions can undergo an oscillatory path while moving through the charging zone 385. In an exemplary embodiment, if the peak-to-peak amplitude of the ion oscillatory path is less than 0.5 mm, a frequency of greater than about 400 kHz can be used for a drift speed of 200 m/s. In this example, the gas speed through the charging device 300 can be as low as 20 m/s depending on the emitter-to-receptor bias, which is much less than speed of sound.

As shown in FIGS. 1-3, when the emitter-to-PR bias (e.g., from the voltage supply 111/222/333) is tailored to the nanotechnology based charging devices, the charging performance of the devices can be significantly improved. In various embodiments, a computer-based model can be used to analyze the operation of the disclosed indirect charging devices (e.g., device 100/200/300) as compared to conventional indirect charging devices where no emitter bias is involved.

The computational model can use, for example, a customized Fidap software package based on the computational fluid dynamics (CFD) solution of the relevant electrohydrodynamic (EHD) equations. In various embodiments, such computational model can utilize the nondimensional version of the EHD equations. That is, all input parameters can be converted to their dimensionless forms before being read into the model, and all the outputs from the model can presented in the nondimensional forms as well. By using this model, the effects of various charging operation variables can be examined and the resulting charging performance (e.g., charging profiles of the receptor) can be predicted and/or determined.

Figure 4:
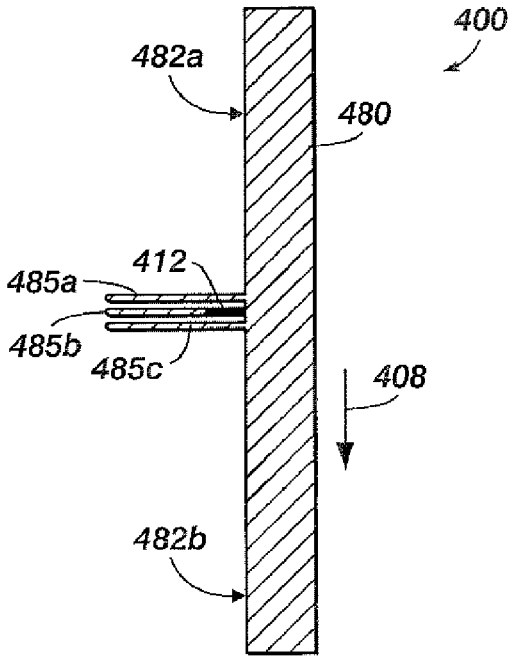
FIG. 4 is an exemplary computational domain of a computational model in accordance with the present teachings.

For example, FIG. 4 is an exemplary computational domain plot 400 generated by the computational model in accordance with the present teachings. The computational domain 400 can include gas channels 485A-C, and a receptor such as photoreceptor (PR) 480. As shown, the gas channels 485A-C can be oriented horizontally, which can be any gas channel or charging zone as depicted in FIGS. 1-3. Accordingly, the computational model can simulate the charging operation of a moving PR 480, e.g., moving vertically downward as indicated by the arrow 408 in FIG. 4.

According to various embodiments, one single channel of the gas channels 485A-C can be examined for simplicity of simulation. For example the middle channel 485B can be turned on with the other two channels 485A and 485C sealed for the simulation. As shown in FIG. 4, at the tip of the middle channel 485B, there can be a region 412 of charge species source from an emitter including the emitter's anode and cathode. The gas flow can extract the charges (ions) from the charge species source region 412 and carry them to the photoreceptor 480. The grid electrodes, that are at the upstream 482*a* and the downstream 482*b* of the charging tip, such as those provided by the second voltage supplies in FIGS. 1-3, can assist the charge deposition process by providing a field to push the charges toward the photoreceptor 480.

According to various embodiments, the computational model can simulate the charging operation of the disclosed charging devices (e.g., as shown in FIGS. 1-3), where an exemplary portion of the PR 480 can move in, throughout, and leave the charging zone (e.g., 105, 205, and 305 in FIGS. 1-3) including the region 412 along with a target surface potential from charging. During this course, the bias electrodes 482 *a-b* can provide an electric field between the charging device at the grid (e.g., 170, 270 and 370 in FIGS. 1-3) and the PR 480 (e.g. 180, 280 and 380 in FIGS. 1-3). For example, prior to entering the charging zone, the electric field can stay constant since there is no or minimal charge species in the region and the surface potential of the photoreceptor 480 can be at, for example 0 V as initially set. As the portion of the PR 480 gets close to the charging zone including the charge species source region 412, a cloud of charges can be delivered to the vicinity of the PR 480 from the region 412. Subsequently, the PR 480 can acquire charges, and the voltage contrast between PR 480 and the counter electrodes 482*a-b* (as opposite to the grid 170/2701370 in FIGS. 1-3) can reduce. At this region, the counter electrode 482 can be discontinued due to the opening of the charge zone (e.g., 105/205/305 in FIGS. 1-3) of the air channel 485.

Given the dimensions of the geometry, the speed and the material of the PR 480 (e.g., 180/280/380 as shown in FIGS. 1-3) and the targeted charging level (i.e., exit voltage), the computational model can mimic the gas flow structure and further determine, for example, the required magnitude of charge density that the emitter needs to generate, the required gas speed to extract the ions from the emitter, electrical potential distribution for the PR 480, and the space charge density distribution profile along the surface of the PR 480.

For example, a general gas flow structure (not shown) relevant to the charging process can show that the gaseous stream comes out from the emitter channel (e.g., 485*b*) at a high speed, impinges onto the PR 480, and splits into two opposite streams along the opposite directions of the PR surface. Further, corresponding electrical potential distribution for the PR 480 can be illustrated from the computational simulation. For example, the PR 480 can come in at an initial 0 V surface potential, entering the modeled domain with this initial voltage (i.e., 0 V) for a long distance, and getting charged to a negative or positive potential depending on the charging polarity. Additionally, space charge density distribution profile along the surface of the PR 480 can be obtained by the computational simulation. For example, when the PR 480 moves through the modeled domain, the charge density distribution can be found localized with charging occurring mostly at the charging nip region (with respect to the region 412 in FIG. 4). Corresponding charging (voltage) profile can be simulated to show the voltage charged on the PR 480 at exit.

Such computational simulation can be used to analyze the disclosed charging devices having the emitter-to-receptor bias (e.g., as shown in FIGS. 1-3) based on a comparison with a conventional charging device (not shown) that is lack of the emitter-to-receptor bias. For example, the negative charging device 100 (as shown in FIG. 1) can be used as an example for the computational examination (shown in FIG. 4), although one of ordinary skill in the art will understand that other charging devices can also be analyzed by the disclosed computational model.

For comparison purpose, the disclosed exemplary negative charging device 100 and the conventional negative charging device (not illustrated) can have same geometry and setpoints for the charging process, except that the disclosed charging device is configured with the emitter-to-receptor bias in accordance with the present teachings. That is, in this example, both receptors (e.g., PRs) enter the charging zone at 0 V, and a −700V surface potential at the exit is targeted. The photoreceptor can be, for example, that of iGen3 printing machine (Xerox Corporation, Webster, N.Y.) and can move at 234 mm/s. The upstream and the downstream bias electrodes (e.g., 482*a-b* in FIG. 4) for the PRs are both set to −700V. The dimensions, such as the gaps, of the gas channel in both cases are 120 microns. The voltage drops across the emitter's electrodes in both cases are about 600V. And, the charging device to receptor gap, e.g., between the gird and the counter electrode shown in FIGS. 1-3, is about 750 microns.

Table 1 compares emitter conditions and charging performances between the disclosed indirect charging device 100 having the emitter-to-PR bias and the conventional indirect charging device that is lack of the emitter-to-PR bias in accordance with the present teachings.

TABLE 1

| | Emitter Conditions | | | Charging Results | |
|---|---|---|---|---|---|
| | Voltage drop (ΔV) | Ion Source (q) | Gas flow (Mach) | Exit PR charging (V) | Target PR charging (V) |
| Case 0 (No bias) | −600 | 300 | 0.8 | −605 | −700 |
| Case 1 (Emitter bias) | −600 | 5 | 0.4 | −663 | −700 |

As shown, in the case when there is no emitter-to-PR bias for the conventional charging device (Case 0), the emitter's cathode is set to be about −600V and its anode is grounded. A uniform ion source of q=300 (non-dimensionalized space charge density) is assigned to the emitter region. A high speed gas flow of about Mach 0.8 is also assigned at the inlet of the gas channel (e.g., the central channel 485B in FIG. 4).

In the case when the emitter-to-PR bias is used for the negative charging device (Case 1), the emitter (as a whole) is now set to a 700V bias with the voltage drop across the emitter assembly still kept at about 600V as that set for the non-emitter-bias charging device (Case 0). For example, the anode of the emitter is at about −700V, and the cathode is at about −1300V for the exemplary negative charging device. Further, the emitter bias charging device has a nondimensional ion source q=5, that is about one sixtieth of the value for Case 0 with non-emitter bias as shown in Table 1. Furthermore, the charging channel inlet gas velocity is about Mach 0.4, which is about half of the velocity as compared with that for the non-emitter-bias charging device of Case 0.

By using the computational simulation illustrated in FIG. 4, the charge density, the electrical potential, the space charge density profile, the voltage profile, and electric field result at the PR 480 can be obtained to examine both Case 0 and Case 1. For example, the voltage profiles (not shown) depict that an exit PR charging voltage for the Case 0, the non-emitter-biased device, is about −605V, while for the Case 1, the emitter-biased device, is about −663V, which is much closer to the target voltage of about −700 at exit.

In other words, for the conventional non-emitter-biased charging device (Case 0), a very high ion source (q=300) and a near-sonic-speed gas flow are needed in order to obtain a high charging level, e.g., a charging level of about −605V, which is still about 95 V short of the targeted charging voltage of about −700V. In this case, it may be possible to achieve the charging target by further elevating the ion source density and/or the gas speed. However, such requirements put on the emitter and the blower for this extreme operation condition would likely come with an unacceptably high cost. On the contrary, for the disclosed emitter-biased charging device, the PR voltage at the exit can be about −663V and although about 37V short of the target charging voltage can be more easily accommodated by more moderate stream velocity and/or ion density changes. Thus, this can be easily compensated by increasing the ion source density and/or the gas flow slightly. Not to mention that such charging level is obtained with a lower ion source of about q=5 and half the gas speed of the non-emitter-biased device (Case 0) as shown in Table 1. In sum, the comparison shown in Table 1 illustrates that the emitter-to-receptor bias is an effective way to drive the charge species from the emitter assembly to the receptor, and it significantly improves the charging performance.

It is further discovered that the electric field can be the primary mechanism for the operation of the disclosed charging device due to the addition of the emitter-to-receptor bias, and the gas flow through the emitter assembly can be a secondary ion extraction mechanism. In contrast, conventional indirect charging devices can have the gas flow as the primary driver for ion extraction. The electric field ion extraction mechanism can be demonstrated by an additional comparison experiments. In this experiment, the gas flow can be turned off leaving the electric field operation for both Case 0 and Case 1 as described above in Table 1. For example, the gas flow can be switched off and the gas channels (e.g., 485*a-c* in FIG. 4) can be opened to the environment. The result shows that, even without externally applied gas flow, the PR 480 having the emitter-to-receptor bias (Case 1) can still be charged to a significant level (e.g., about −613V) with respect to the original charging voltage of about −663V (shown in Table 1). This reveals that the electric field can contribute as a primary mechanism of charging for the emitter biased device, and the gas flow can play a secondary role. Consequently, lower velocity gas streams can be used in the gas channel and can also be used alternately to protect the emitter assembly from contaminants (e.g., dirt, or vapors) from the environment.

In various embodiments, the design and operation of disclosed indirect charging devices can be modified to improve their charging performance. In the example of Case 1 as described above, to reduce the risk of sparking or electric shorting between the cathode of the emitter (e.g., −1300V) and the downstream bias electrode (e.g., −700V) for the PR 480, the two bias electrodes 485*a-b* can be separated farther from the emitter assembly (i.e., moved farther apart from their original positions), specifically, from the center of the charging zone (105 in FIG. 1). In this case, in addition to the reduction of the risk of sparking, the charging profile shows that the PR 480 can have an exit charging voltage of about −699V, which is almost at the charging level target. In various embodiments, the distance between the receptor (e.g., 180/280/380 of FIGS. 1-3) and the aperture electrode (e.g., 170/270/370 of FIGS. 1-3) can range from about 0.5 mm to 3.0 mm for the disclosed charging devices.

In this manner, the voltage bias established between the emitter and the receptor, coupled with an appropriately chosen electric field from emitter's anode to cathode and a low velocity gas (e.g., air) stream can be used to appropriately charge a receptor over a broad range of process speeds. The disclosed charging systems and methods can be used, for example, in electrostatic reproduction (e.g., imaging formation) that involves an electrostatically-formed latent image on a charged receptor (e.g., photoreceptor). The latent image can be developed by bringing charged developer materials, e.g., charged toner particles, into contact with the photoreceptor. The toner particles can adhere directly to a donor roll by electrostatic charges from a magnet or developer roll and can be transferred to the charged photoreceptor from a toner cloud generated in the gap between the charged photoreceptor and the donor roll during the development process.

It should be appreciated that, while disclosed systems and methods have been described in conjunction with exemplary electrophotographic and/or xerographic image forming devices, systems and methods according to this disclosure are not limited to such applications. Exemplary embodiments of systems and methods according to this disclosure can be advantageously applied to virtually any device to which charge is to be imparted or controlled.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A charging device comprising:

a first electrode;

a second electrode separated from the first electrode;

a plurality of nanostructures contacting at least one of the first electrode and the second electrode;

a first voltage supply connected between the first electrode and the second electrode, wherein the first electrode and the second electrode impart charge to a portion of a gaseous material in a charging zone between the first and the second electrode that is deposited on a receptor;

a second voltage supply connected between the receptor and one of the first electrode and the second electrode, wherein the second voltage supply is configured to generate an electric field to direct charged gaseous material onto the receptor; and a third voltage supply connected between the receptor and an aperture electrode and arranged to supply a potential difference between the receptor and the aperture electrode to enable a flow of gaseous material to have a velocity below about 100 m/s and a nondimensional space charge density less than about 5, wherein the aperture electrode is arranged between both the first and the second electrode and the receptor and in a flow path of the charged gaseous material.

2. The device of claim 1, further comprising:

a gas supply unit that supplies the gaseous material between the first electrode and the second electrode.

3. The device of claim 1, wherein the gaseous material flows between the first electrode and the second electrode at a velocity ranging from about 0 to about 150 m/s.

4. The device of claim 1, wherein the nanostructures are selected from the group consisting of carbon, boron nitride, zinc oxide, bismuth, metals, metal oxides, doped metal oxides, metal chalcogenides and combinations thereof.

5. The device of claim 1, wherein the nanostructures are selected from the group consisting of carbon nanotubes (CNTs), Boron Nitride (BN) nanotubes, single-walled nanotubes (SWNT), multi-walled nanotubes (MWNT), metal nano-rods, nano-wires, ZnO nanowires, doped ZnO nanowires, nano-fibers, nano-whiskers, nano-spirals, nano-horns and combinations thereof.

6. The device of claim 1, wherein the nanostructures adhere to the first electrode, and wherein the first voltage supply provides a negative electrical bias to the first electrode.

7. The device of claim 6, wherein the negative voltage supply provides an electric field of from about 0.1 V/μm to about 5.0 V/μm between the first electrode and the second electrode, and the second voltage supply provides a negative electrical bias to the one of the first electrode and the second electrode having voltage of from about 400 volts to about 900 volts.

8. The device of claim 1, wherein the nanostructures adhere to the first electrode, and wherein the first voltage supply provides a positive electrical bias to the first electrode.

9. The device of claim 8, wherein the first voltage supply provides an electric field between the first electrode and the second electrode, and the second voltage supply provides a positive electrical bias to the one of the first electrode and the second electrode having voltage of from about 400 volts to about 900 volts.

10. The device of claim 1, wherein the nanostructures adhere to both the first electrode and the second electrode, and wherein the first voltage supply provides an AC electrical bias between the first electrode and the second electrode.

11. The device of claim 10, wherein the AC voltage supply provides an electric field of from about 0.1 V/μm to about 5.0 V/μm between the first electrode and the second electrode, and the second voltage supply provides a negative electrical bias to the one of the first electrode and the second electrode having voltage of from about 400V to about 900V.

12. An electrophotographic printing device comprising the charging device according to claim 1.

13. A charging device comprising:

a first electrode;

a second electrode separated from the first electrode by a gap, wherein the first electrode and the second electrode are arranged to impart charge to a portion of a gaseous material in a charging zone in the gap;

a plurality of nanostructures contacting at least one of the first electrode and the second electrode;

a receptor positioned adjacent to the gap separating the first electrode from the second electrode;

an aperture electrode in close proximity to the gap separating the first electrode and the second electrode and positioned in a space between the receptor and the charging zone;

a first voltage supply connected between the first electrode and the second electrode;

a second voltage supply connected between the aperture electrode and the receptor; and a third voltage supply connected between one of the first electrode and the second electrode and the receptor and arranged to enable a flow of gaseous material to have a velocity below about 100 m/s and a nondimensional space charge density less than about 5, wherein the third voltage supply is configured to generate an electric field to direct charged gaseous material onto the receptor.

14. The charging device of claim 13, further comprising:

a gas supply unit that supplies a gaseous material through the gap.

15. The charging device of claim 13, wherein an electric field generated by the first voltage supply on the nanostructures charges a portion of the gaseous material, and wherein the charged portion of the gaseous material is directed to the receptor through the aperture electrode due to the second voltage supply providing a voltage between the aperture electrode and the receptor and the third voltage supply providing a voltage between the one of the first electrode and the second electrode and the receptor.

16. The charging device of claim 13, wherein the first voltage supply provides an electric field of from about 0.1 V/μm to about 5.0V/μm between the first electrode and the second electrode, and the third voltage supply provides a voltage of from about 400 V to about 900 V between the one of the first electrode and the second electrode and the receptor.

17. The charging device of claim 13, wherein a charging performance of the receptor is controlled by a distance between the aperture electrode and the receptor, wherein the distance ranges from about 0.5 to about 3 mm.

18. A method of charging a receptor in a charging device comprising:

applying a first voltage between a first electrode and a second electrode, wherein at least one of the first electrode and the second electrode is coated with a plurality of nanostructures;

supplying a gaseous material at a speed to a charging zone between the first and second electrode, such that an electric field on the nanostructures charges a portion of the gaseous material; and directing the charged gaseous material towards a receptor using a second voltage bias between the receptor and an aperture electrode and a third electric bias between the receptor and one of the first electrode and the second electrode, wherein the third electric bias is arranged to enable a flow of gaseous material to have a velocity below about 100 m/s and a nondimensional space charge density less than about 5.

19. The method of claim 18, wherein the aperture electrode is in close proximity to a gap separating the first electrode and the second electrode and positioned in a space between the receptor and the gap.

20. The method of claim 18, wherein the first voltage supply provides one of a direct current (DC) bias, a pulsed-DC, and a biased alternating current (AC) between the first electrode and the second electrode.

21. The method of claim 18, wherein the portion of the gaseous material is charged by processes selected from the group consisting of an electron emission, an ionization, a micro-corona, an electron attachment, a dissociative electron attachment occurring in a region between the first electrode and the second electrode and combinations thereof.

* * * * *